US010173752B2

(12) United States Patent
Takeda

(10) Patent No.: US 10,173,752 B2
(45) Date of Patent: Jan. 8, 2019

(54) SHIP

(71) Applicant: MITSUBISHI HEAVY INDUSTRIES, LTD., Tokyo (JP)

(72) Inventor: Shingen Takeda, Tokyo (JP)

(73) Assignee: MITSUBISHI SHIPBUILDING CO., LTD., Yokohama-Shi, Kanagawa (JP)

( * ) Notice: Subject to any disclaimer, the term of this patent is extended or adjusted under 35 U.S.C. 154(b) by 0 days.

(21) Appl. No.: 15/106,984

(22) PCT Filed: Oct. 13, 2015

(86) PCT No.: PCT/JP2015/078882
§ 371 (c)(1),
(2) Date: Mar. 2, 2017

(87) PCT Pub. No.: WO2017/064748
PCT Pub. Date: Apr. 20, 2017

(65) Prior Publication Data
US 2017/0217545 A1 Aug. 3, 2017

(51) Int. Cl.
*B63B 3/56* (2006.01)
*B63B 43/04* (2006.01)
(Continued)

(52) U.S. Cl.
CPC ..... *B63B 3/56* (2013.01); *B63B 43/04* (2013.01); *B63B 43/06* (2013.01); *B63B 43/24* (2013.01)

(58) Field of Classification Search
CPC ..... B63B 11/02; B63B 13/00; B63B 43/02; B63B 43/06; B63B 43/10; B63B 43/12; B63B 43/14; B63B 43/04; B63B 43/24
(Continued)

(56) References Cited

U.S. PATENT DOCUMENTS 3,745,960 A * 7/1973 Devine ..... B63B 25/10 114/78
4,964,437 A * 10/1990 Tornay ..... B63B 25/082 114/125
(Continued)

FOREIGN PATENT DOCUMENTS

GB 1416178 A 12/1975
JP 2007-203980 A 8/2007
(Continued)

OTHER PUBLICATIONS

Europe Patent Office, "Search Report for European Patent Application No. 15871288.5," dated Jan. 19, 2017.
(Continued)

*Primary Examiner* — Lars A Olson
(74) *Attorney, Agent, or Firm* — Manabu Kanesaka; Benjamin Hauptman; Kenneth Berner

(57) ABSTRACT

A ship (1) includes a hull (2) having side shells (3A, 3B) formed at both sides in athwart ship direction, a pair of watertight compartments (6A, 6B) installed along the side shells (3A, 3B) of both sides in the athwart ship direction in the hull (2) and portions of which are divided and formed by the side shells (3A, 3B), a connection section (7) configured to bring the pair of watertight compartments (6A, 6B) in connection with each other, an opening/closing valve (8) installed at the connection section (7), and a control device (9) configured to control the opening and closing of the opening/closing valve (8), wherein the control device (9) switches the opening/closing valve (8) in an open state into a closed state when a predetermined condition is satisfied after receiving a signal indicating damage to the side shell (3A) has occurred.

3 Claims, 6 Drawing Sheets

(51) Int. Cl.
*B63B 43/06* (2006.01)
*B63B 43/24* (2006.01)

(58) Field of Classification Search
USPC ..... 114/68, 78
See application file for complete search history.

(56) References Cited

U.S. PATENT DOCUMENTS 5,477,797 A * 12/1995 Stuart ..... B63B 25/082 114/125
6,450,254 B1 * 9/2002 Hoyle ..... B63B 43/02 165/101
2015/0122166 A1 5/2015 Yamato et al.

FOREIGN PATENT DOCUMENTS

JP 2009-220626 A 10/2009
JP 2013-133030 A 7/2013
JP 2014-097683 A 5/2014
JP 2015-013556 A 1/2015

OTHER PUBLICATIONS

PCT/ISA/210, "International Search Report for International Application No. PCT/JP2015/078882," dated Dec. 22, 2015.
PCT/ISA/237, "Written Opinion of the International Searching Authority for International Application No. PCT/JP2015/078882," dated Dec. 22, 2015.

* cited by examiner

SHIP

RELATED APPLICATIONS

The present application is National Phase of International Application No. PCT/JP2015/078882 filed Oct. 13, 2015, the disclosure of which is hereby incorporated by reference herein in its entirety.

TECHNICAL FIELD

The present invention relates to a ship.

BACKGROUND ART

A ship heels toward a side, when damage occurs at either of port and starboard side shells resulting in flooding of the hull. In this case, the ship is designed to have adequate stability that it can come to a safe equilibrium from the inclined state.

Such a ship is required to be capable of stable self-navigation to the nearest port after being damaged and flooded.

Patent Literature 1 discloses a configuration in which a compartment at the port side and a compartment at the starboard side of the hull are brought in connection with each other. According to the configuration, when a compartment of the two compartments is flooded, since water can be moved to a second compartment, the heeling of the hull can be reduced and stability can be increased.

Patent Literature 2 discloses a ship having a pair of ballast tanks separated in athwart ship direction, a connection pipe configured to bring the ballast tanks in connection with each other, and a valve configured to open and close the connection pipe. The ship disclosed in Patent Literature 2 is configured such that a valve is opened to move ballast water using potential energy when the heel of the hull exceeds a threshold and is closed when the heel of the hull is less than the threshold.

CITATION LIST

Patent Literature

[Patent Literature 1]

Japanese Unexamined Patent Application, First Publication No. 2013-133030

[Patent Literature 2]

Japanese Unexamined Patent Application, First Publication No. 2014-097683

SUMMARY OF INVENTION

Technical Problem

The above-mentioned connection pipe (cross flooding) can reduce a heel angle. However, the connection pipe can cause ingress of flooding from a flooded first compartment to a sound second compartment that is not flooded. As a result, the hull may become instable due to the effect of free water that comes and goes through the connection pipe. When the hull is instable due to the free surface effect, the stable self-navigation cannot be easily performed.

The present invention is directed to provide a ship capable of suppressing inclination and swing of a hull to obtain a high stability and enabling stable self-navigation when a side shell is damaged and the inside of the hull is flooded.

Solution to Problem

According to a first aspect of the present invention, a ship includes a hull having side shells at both sides in athwart ship direction. The ship further includes a first watertight compartment formed at one side in the athwart ship direction and a portion of which is divided and formed by the side shell of the first side. The ship further includes a second watertight compartment formed on the other side and a portion of which is divided and formed by the side shell of the second side. The ship further includes a connection section configured to bring the first watertight compartment and the second watertight compartment in connection with each other. The ship includes an opening/closing valve configured to open and close the connection section, and a control device configured to control the opening and closing of the opening/closing valve. The control device switches the opening/closing valve in an open state into a closed state when a predetermined condition is satisfied after receiving a signal indicating damage to the side shell.

According to the above-mentioned configuration, upon occurrence of the damage to the side shell, the opening/closing valve can be switched into the open state. Accordingly, water can be guided from the first watertight compartment that is damaged into the second watertight compartment that is not damaged. Accordingly, the heel of the hull can be attenuated.

Further, after the water is guided from the first watertight compartment into the second watertight compartment, when the predetermined condition is satisfied, the opening/closing valve can be automatically switched into the closed state. As a result, the water can be stopped from coming and going between the first watertight compartment and the second watertight compartment to reduce the free surface effect. Accordingly, the occurrence of the swing in the ship width direction in the hull can be suppressed, and stable self-navigation becomes possible.

According to a second aspect of the present invention, in the ship, the control device according to the first aspect may switch the opening/closing valve into the closed state when a condition, that an elapsed time from reception of the signal indicating damage to the side shell reaches a predetermined setting time, is satisfied as the predetermined condition.

Accordingly, when the elapsed time reaches the setting time, the opening/closing valve can be switched into the closed state. Accordingly, the water can be stopped from coming and going between the first watertight compartment and the second watertight compartment to reduce the free surface effect. As a result, stable self-navigation becomes possible.

According to a third aspect of the present invention, in the ship, the control device according to the second aspect may switch the opening/closing valve into the closed state when either, which is earlier, of a condition among which the elapsed time reaches the predetermined setting time and the hull has a predetermined amplitude is satisfied as the predetermined condition.

Accordingly, for example, before the elapsed time reaches the predetermined setting time, when the hull has the predetermined amplitude, the opening/closing valve can be switched into the closed state. Accordingly, self-navigation becomes possible earlier.

According to a fourth aspect of the present invention, in the ship, the control device according to the first aspect may switch the opening/closing valve into the closed state when a condition that the hull has a predetermined amplitude is satisfied as the predetermined condition.

According to the above-mentioned configuration, the opening/closing valve can be switched into the closed state when roll amplitude of the hull is reduced. As a result, in a state in which the hull becomes closer to an equilibrium state, stable self-navigation becomes possible.

According to a fifth aspect of the present invention, in the ship, the control device according to any one of the first to fourth aspects may switch the opening/closing valve into an open state when the signal indicating damage to the side shell is received, and switches the opening/closing valve in the open state into a closed state when the predetermined condition is satisfied, where the opening/closing valve is normally in the closed state.

When the watertight compartment is a member configured to accommodate a liquid, for example, a ballast tank or the like, the opening/closing valve is normally in the closed state. In this case, the opening/closing valve is switched into the open state when the signal indicating damage to the side shell is received, the opening/closing valve in the open state can be switched into the closed state when the predetermined condition is satisfied. Accordingly, even when the opening/closing valve is normally in the closed state, the free surface effect can be reduced while attenuating the heel of the hull. As a result, stable self-navigation becomes possible.

Advantageous Effects of Invention

According to the above-mentioned ship, when the side shell is damaged and the inside of the hull is flooded, the heel and rolling of the hull can be suppressed to obtain a high stability, and stable self-navigation becomes possible.

DESCRIPTION OF EMBODIMENTS

First Embodiment

Figure 1:
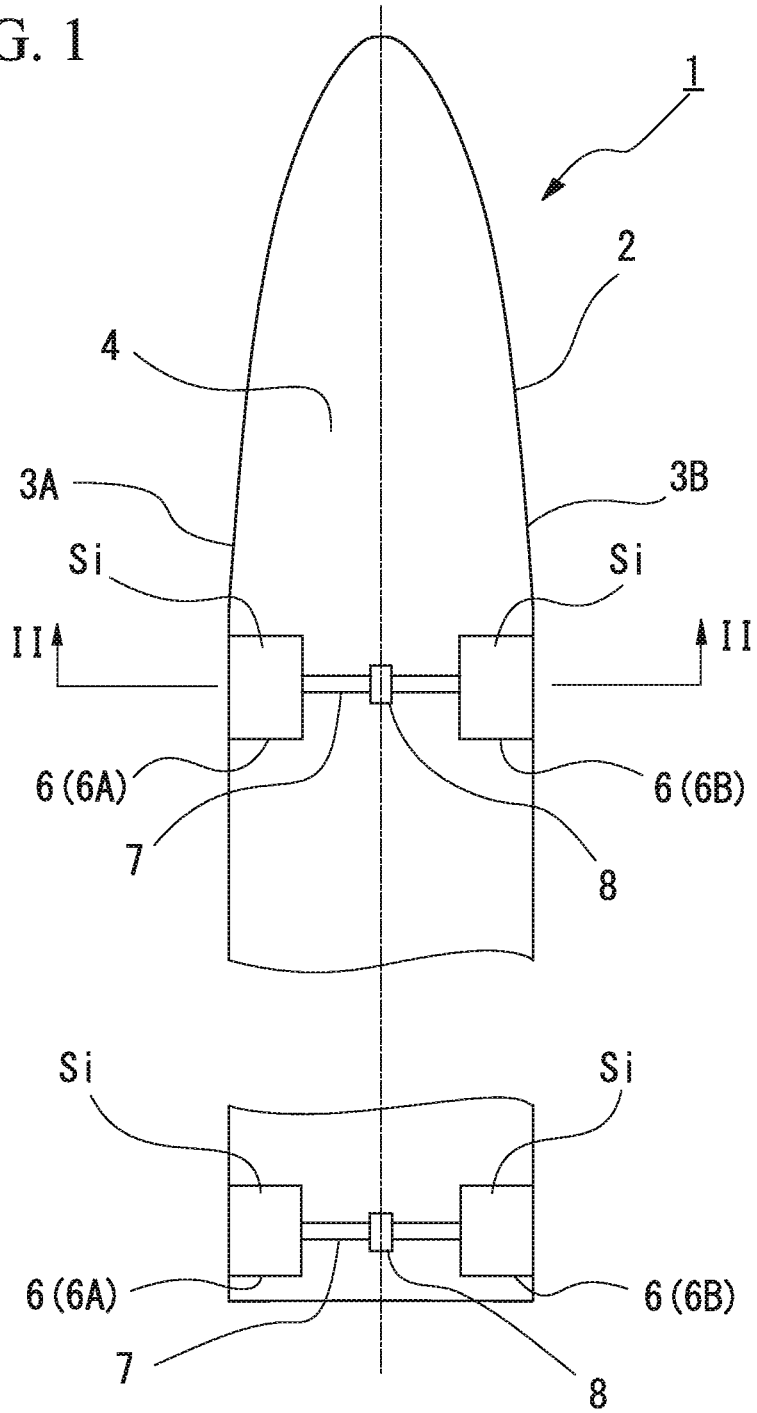
FIG. 1 is a plan view showing a watertight compartment, a connection section and an opening/closing valve installed in a hull of a ship according to a first embodiment of the present invention.
Figure 2:
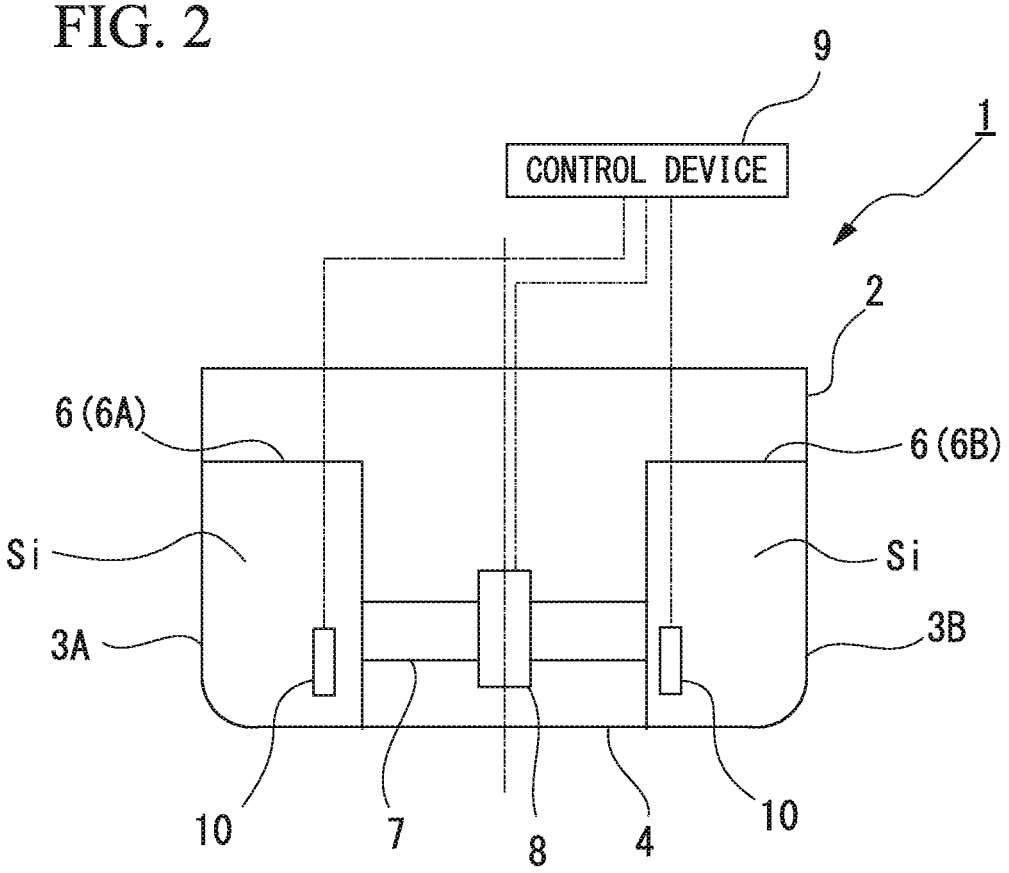
FIG. 2 is a cross-sectional view showing the watertight compartment, the connection section and the opening/closing valve installed in the hull of the ship according to the first embodiment of the present invention, taken along line II-II of FIG. 1.

FIG. 1 is a plan view showing a watertight compartment, a connection section and an opening/closing valve installed in the hull of a ship according to a first embodiment of the present invention. FIG. 2 is a cross-sectional view showing the watertight compartment, the connection section and the opening/closing valve installed in the hull of the ship, taken along line II-II of FIG. 1.

As shown in FIGS. 1 and 2, a ship 1 of the embodiment includes a hull 2, a watertight compartment 6, a connection pipe (a connection section) 7, an opening/closing valve 8 and a control device 9.

The hull 2 has side shells 3A and 3B and a ship's bottom 4. The side shells 3A and 3B are constituted by outer plates of ship sides installed at both sides in athwart ship direction, respectively. The ship's bottom 4 is constituted by an outer plate of the ship's bottom that connects the side shells 3A and 3B. The hull 2 has a U-shaped cross-section perpendicular to a fore and aft direction by the pair of side shells 3A and 3B and the ship's bottom 4.

A surface of the watertight compartment 6 is divided and formed in the hull 2 by the side shell 3A or the side shell 3B. The watertight compartment 6 forms an internal space Si therein. The watertight compartment 6 may be used as, for example, a storeroom, an empty space, a cargo compartment, a stabilizer chamber, an equipment room configured to accommodate equipment or the like, a pipe space in which pipes are deployed, or the like.

The connection pipe 7 is installed between a first watertight compartment 6A at a side (first side), close to the side shell 3A and a second watertight compartment 6B at the other side close to the side shell 3B (second side) in athwart ship direction of the hull 2. The connection pipe 7 brings the first watertight compartment 6A and the second watertight compartment 6B in connection with each other.

The opening/closing valve 8 can open and close the connection pipe 7. When the opening/closing valve 8 is opened, the internal space Si of the first watertight compartment 6A and the internal space Si of the second watertight compartment 6B come in connection with each other. The opening/closing valve 8 of the embodiment is in an open state at normal times when no damage occurs in the side shells 3A and 3B.

The control device 9 controls an opening/closing operation of the opening/closing valve 8. The opening/closing operation of the opening/closing valve 8 is automatically controlled by the control device 9.

Figure 3:
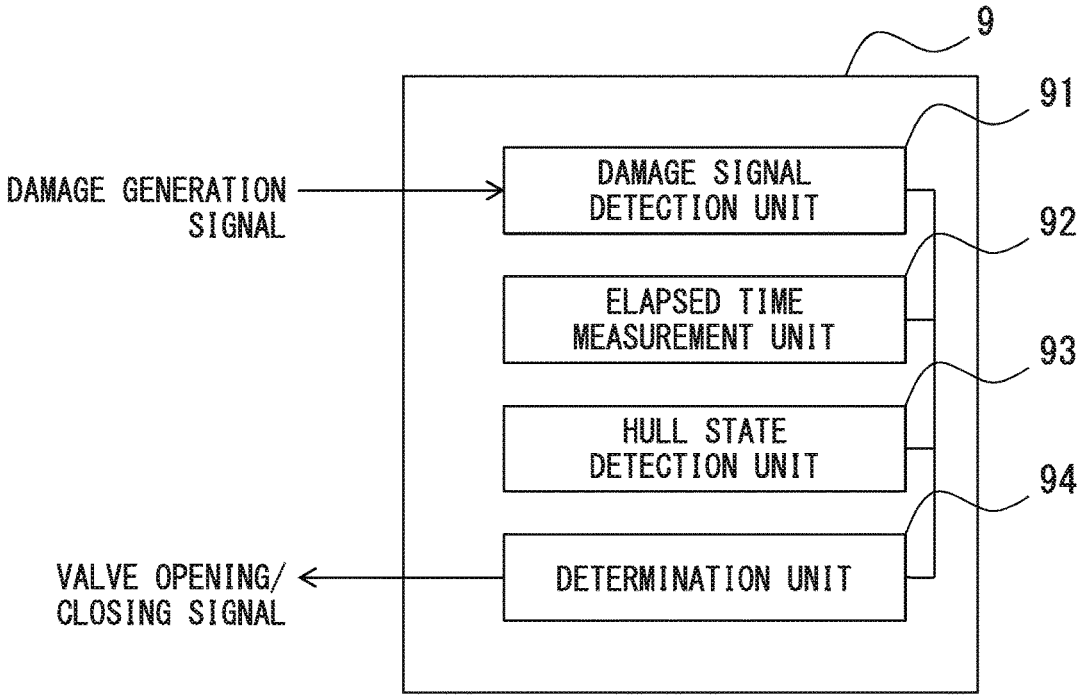
FIG. 3 is a view showing a functional configuration of a control device according to the first embodiment of the present invention.

FIG. 3 is a view showing a functional configuration of the control device.

As shown in FIG. 3, the control device 9 functionally includes a damage signal detection unit 91, an elapsed time measurement unit 92, a hull state detection unit 93 and a determination unit 94.

The damage signal detection unit 91 detects a damage generation signal (a signal indicating occurrence of damage to the side shell) caused when the hull 2 is damaged and flooding in the hull 2 is detected. The damage generation signal caused when the hull 2 is damaged and the flooding into the hull 2 is detected can be, for example, a signal caused by manipulation of a predetermined button (not shown) by a crewmate who detects the damage of the hull 2 and the flooding into the hull 2, a signal caused when the flooding is detected by a flooding detection sensor 10 (see FIG. 2) installed at the watertight compartment 6, or the like, may be exemplified.

After the damage generation signal is detected by the damage signal detection unit 91, the elapsed time measurement unit 92 measures an elapsed time from detection of the damage generation signal and outputs a signal indicating the elapsed time that is measured.

The hull state detection unit 93 detects heel angle of the hull 2, roll amplitude due to the rolling of the hull 2, or the like, using an inclination sensor or the like, and outputs the detected signal.

The determination unit 94 determines an opening/closing timing of the opening/closing valve 8 based on the signal indicating the elapsed time output from the elapsed time measurement unit 92 and the signal output from the hull state detection unit 93.

The control device 9 switches the opening/closing valve 8 into a closed state when it is determined that a predetermined condition is satisfied, after the damage generation signal indicating generation of the damage to the hull 2 is input.

Next, a specific righting method of the ship 1 realized by control of the control device 9 will be described.

Figure 4:
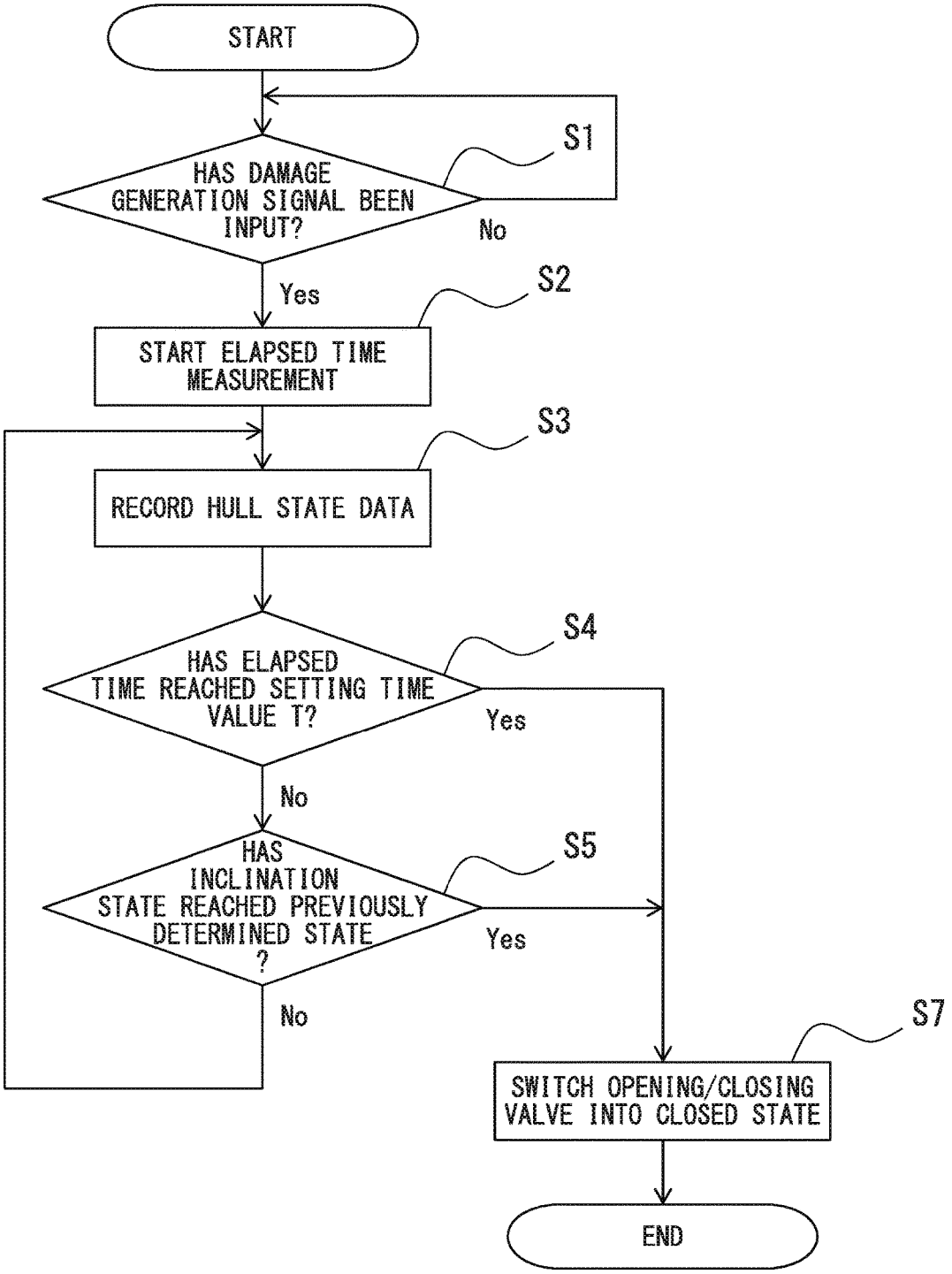
FIG. 4 is a view showing a flow of a righting process of the ship, which is performed by a control device according to the first embodiment of the present invention.

FIG. 4 is a view showing a flow of a righting process of the ship performed by the control device.

As shown in FIG. 4, the damage signal detection unit 91 of the control device 9 determines whether the damage generation signal has been input. Specifically, when the damage occurs in the side shell 3A or the side shell 3B (in the embodiment, the side shell 3A) of the hull 2, water intrudes into the first watertight compartment 6A from the side shell 3A. Then, the damage generation signal is input into the damage signal detection unit 91 by the signal caused by the predetermined button manipulation by the crewmate who detects the damage of the hull 2 and the flooding into the hull 2, the signal caused when the flooding is detected by the flooding detection sensor installed at the watertight compartment 6, or the like (in step S1, "Yes").

The damage signal detection unit 91 detects the presence or absence of an input of the damage generation signal every fixed time period.

When the damage generation signal is detected by the damage signal detection unit 91, the elapsed time measurement unit 92 of the control device 9 starts the measurement of the elapsed time from the detection of the damage generation signal (step S2). The elapsed time measurement unit 92 outputs a signal indicating the measured elapsed time.

Here, the hull state detection unit 93 detects the heel angle of the hull 2, the amplitude of the rolling of the hull 2, and so on, every fixed small time period using the inclination sensor or the like, and outputs the detected signal. The control device 9 records data such as the heel angle of the hull 2, the roll amplitude of the hull 2, and so on, output from the hull state detection unit 93 in a storage region such as a memory or the like (step S3).

Figure 5:
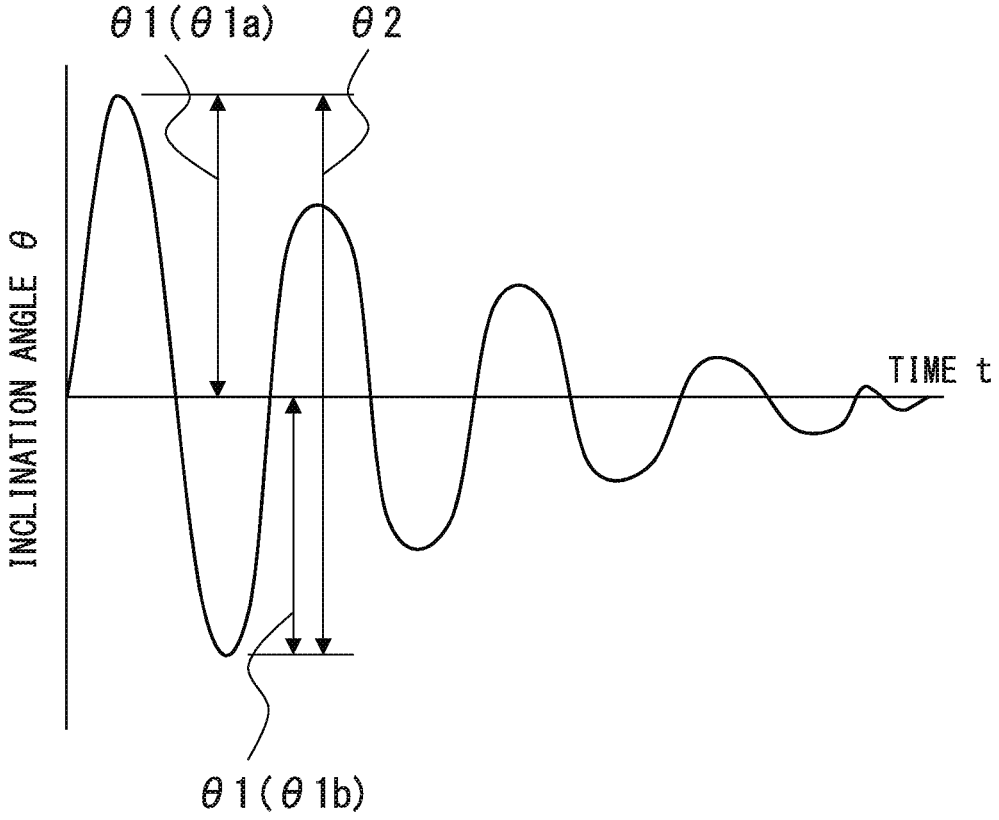
FIG. 5 is a graph showing a variation in rolling amplitude of the hull when water flooded into a first watertight compartment due to damage flows into a second watertight compartment through a connection pipe, according to the first embodiment of the present invention.

FIG. 5 is a graph showing a variation in amplitude of the rolling of the hull when water flooded into the first watertight compartment due to the damage flows into the second watertight compartment through the connection pipe. In FIG. 5, a vertical axis represents heel angle θ and horizontal axis represents time t. On the vertical axis, the heel angle to the damaged side is shown increasing in an upward direction, and the inclination angle to the opposite side of the damaged side is shown increasing in a downward direction.

The ship 1 is inclined such that an outer surface of the side shell 3A is directed downward when water intrudes into the first watertight compartment 6A of the side shell 3A side in which the damage occurs. Some of the water intruding into the first watertight compartment 6A flows into the second watertight compartment 6B through the connection pipe 7. Then, the hull 2 in which the side shell 3A is directed downward return to the normal position (a state of stable equilibrium) that was originally stabilized.

The water flowing into the second watertight compartment 6B collides with the side shell 3B and rebounds therefrom, and some of the water flows into the first watertight compartment 6A through the connection pipe 7. Then, the hull 2 heels toward the side shell 3A again.

That is, as shown in FIG. 5, as the water comes and goes between the first watertight compartment 6A and the second watertight compartment 6B through the connection pipe 7, the hull 2 rolls.

The determination unit 94 of the control device 9 monitors the signal indicating the elapsed time from the elapsed time measurement unit 92 and the signal indicating the roll amplitude or the like of the hull 2 output from the hull state detection unit 93 while the ship 1 rolls as described above.

Specifically, the determination unit 94 determines whether the elapsed time has reached a predetermined setting time value T every fixed time period (step S4). Here, the setting time value T may be set to, for example, 5 to 15 minutes. Further, the setting time value T may be set to about 10 minutes.

The control device 9 continues the process according to the determination result of the determination unit 94 when the elapsed time has not reached the setting time value T. The control device 9 outputs a signal that switches the opening/closing valve 8 into the closed state according to the determination result of the determination unit 94 when the elapsed time has reached the setting time value T (step S7).

Further, the determination unit 94 determines whether the roll amplitude of the hull 2 has reached the predetermined amplitude every fixed time period based on the signal indicating the heel angle or the like of the hull 2 output from the hull state detection unit 93 (step S5). Here, for example, a heel angle θ1 from the stable normal state of the hull 2, an amplitude θ2 of the hull 2, or the like, is used as the heel angle of the hull 2.

The heel angle θ1 can be acquired by the signal output from the hull state detection unit 93. When the state of the hull 2 is evaluated by the heel angle θ1, the determination unit 94 determines whether the heel angle θ1 is a predetermined threshold θt or less. The threshold θt may be, for example, 10°, preferably 7°, and more preferably, 2°.

Further, the amplitude 02 is obtained by, for example, adding a maximum value θ1*a* to the side shell 3A side of the hull 2 and an absolute value of a minimum value θ1*b* to the side shell 3B side within one cycle of the roll of the hull 2 ($\theta 2 = \theta 1a + |\theta 1b|$). The determination unit 94 determines whether the amplitude θ2 is a predetermined threshold θs or less. The threshold θs may be, for example, 5°, or may be preferably 2°.

Here, the above-mentioned roll of the hull 2 is not only the case in which the hull 2 repeatedly rolls leftward and rightward having the upright position (a position at which the inclination angle become "0") as reference. For example, the hull 2 may repeatedly roll leftward and rightward with respect to the above-mentioned inclination angle θ1 (for example, 2° or the like).

The control device 9 continues the process according to the determination result of the determination unit 94 when the predetermined condition is not satisfied (returns to step S3).

The control device 9 outputs a signal of switching the opening/closing valve 8 into the closed state according to the determination result of the determination unit 94 when the predetermined condition is satisfied (step S7).

The opening/closing valve 8 is switched into the closed state when the signal of switching the opening/closing valve 8 into the closed state is output from the control device 9.

When the opening/closing valve 8 is switched into the closed state, water no longer comes and goes between the first watertight compartment 6A and the second watertight compartment 6B through the connection pipe 7. Then, the water oscillates only in the first watertight compartment 6A or only in the second watertight compartment 6B.

Accordingly, according to the above-mentioned first embodiment, upon occurrence of damage to the side shell 3A, the water is guided from the first watertight compartment 6A that is damaged to the second watertight compartment 6B that is not damaged. Accordingly, the inclination of the hull 2 is attenuated.

Further, after the water is guided from the first watertight compartment 6A into the second watertight compartment 6B, when the predetermined condition is satisfied, the water no longer comes and goes between the first watertight compartment 6A and the second watertight compartment 6B by switching the opening/closing valve 8 into the closed state. For this reason, the free surface effect can be reduced. As a result, the roll of the hull 2 can be suppressed.

That is, when the side shell 3A or 3B is damaged and the inside of the hull 2 is flooded, since the roll in the ship width direction of the hull 2 is suppressed in the state in which the heel of the hull 2 is attenuated, i.e., in a state in which the hull 2 is stabilized, stable self-navigation becomes possible.

Further, since the control device 9 switches the opening/closing valve 8 into the closed state when the elapsed time reaches the setting time, at this time, the water can no longer oscillate between the first watertight compartment 6A and the second watertight compartment 6B reducing the free surface effect. As a result, stable self-navigation becomes possible.

Further, since the control device 9 switches the opening/closing valve 8 into the closed state when the hull 2 has a predetermined roll amplitude, i.e., when the roll amplitude of the hull is reduced, stable self-navigation becomes possible in a state in which the hull 2 further approaches the equilibrium state.

Further, before the elapsed time reaches the predetermined setting time, when the hull 2 has the predetermined amplitude, the opening/closing valve 8 can be switched into the closed state. Accordingly, the self-navigation can be performed early.

Second Embodiment

Next, a second embodiment of a ship according to the present invention will be described. In the first embodiment, the watertight compartment 6 is the storeroom, the empty space, the cargo compartment, the stabilizer chamber, the equipment room configured to accommodate equipment or the like, the pipe space in which pipes are deployed, and so on. On the other hand, in the second embodiment, the watertight compartment 6 accommodates liquid. For this reason, in the description of the second embodiment, the same parts as the first embodiment will be described while being designated by the same reference numerals, in all of the configurations or the like of the ship in common with the same configurations described in the first embodiment, description thereof will be omitted.

In the ship 1 of the embodiment, the watertight compartment 6 is, for example, a fuel tank configured to store fuel, a ballast tank configured to accommodate ballast water, a fresh water tank configured to accommodate fresh water, or a waste disposal space in which waste is stored, and liquid is accommodated in the internal space Si.

The connection pipe 7 configured to bring the first watertight compartment 6A close to the side shell 3A and the second watertight compartment 6B close to the side shell 3B in connection with each other is arranged between the compartments 6A and 6B in the athwart ship direction of the hull 2. The opening/closing valve 8 is installed at the connection pipe 7 to enable opening and closing of the connection pipe 7.

In the embodiment, the opening/closing valve 8 is normally in a closed state.

The opening/closing operation of the opening/closing valve 8 is automatically controlled by the control device 9.

Next, a specific righting method of the ship 1 realized by control of the control device 9 of the second embodiment will be described.

Figure 6:
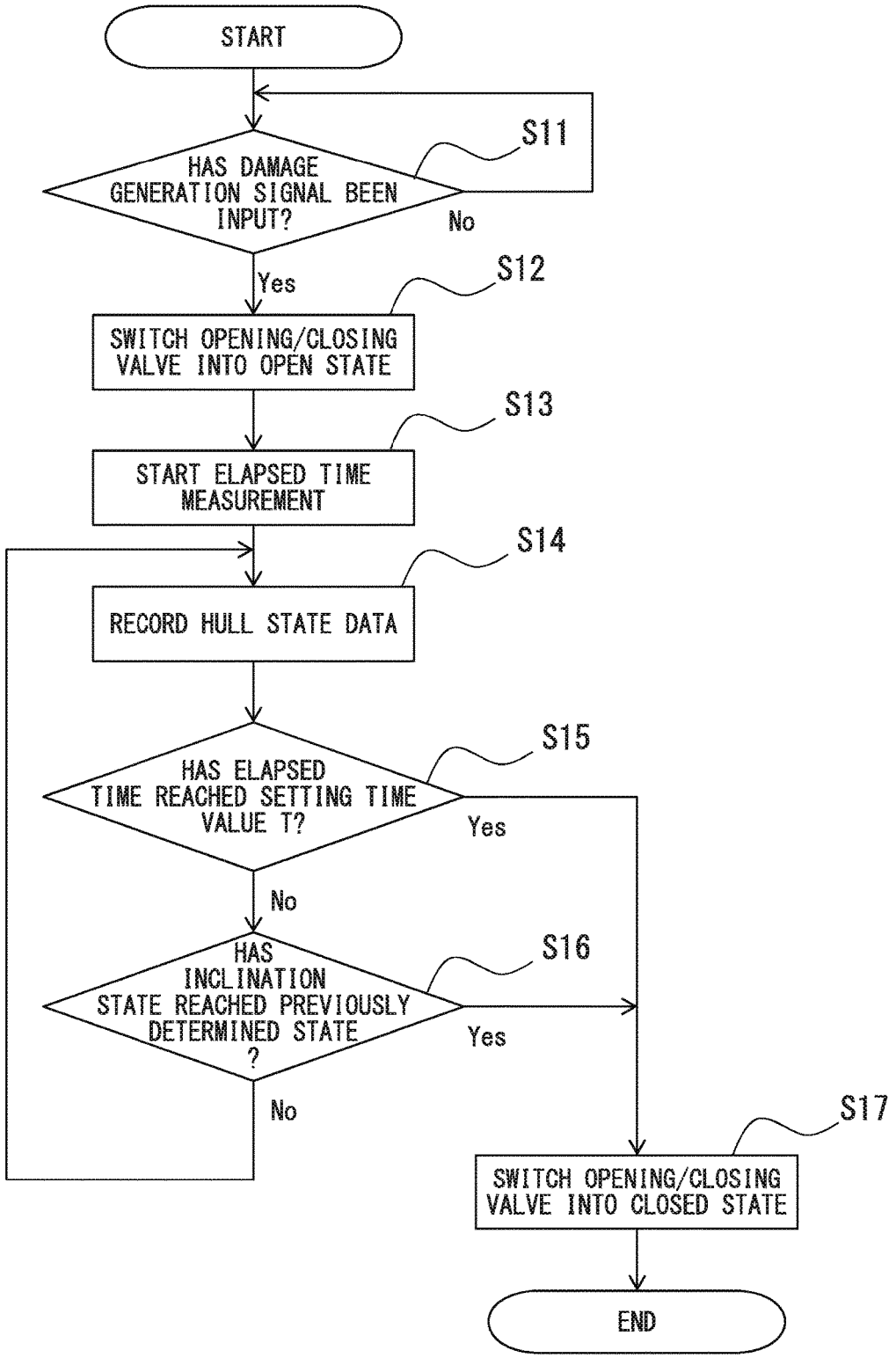
FIG. 6 is a view showing a flow of a righting process of a ship performed by a control device of the ship according to the second embodiment of the present invention.

FIG. 6 is a view showing a flow of a righting process of the ship performed by a control device of the ship according to the second embodiment.

As shown in FIG. 6, the damage signal detection unit 91 of the control device 9 determines whether a damage generation signal has been input. Specifically, like the first embodiment, when the side shell 3A or the side shell 3B (in the embodiment, the side shell 3A) of the hull 2 is damaged, water intrudes into the first watertight compartment 6A from the side shell 3A. Then, the damage generation signal is input into the damage signal detection unit 91 by the signal caused by the predetermined button manipulation by a crewmate who detects the damage to the hull 2 and the flooding into the hull 2, the signal caused when the flooding is detected by the flooding detection sensor installed at the watertight compartment 6, or the like.

When the damage generation signal is detected by the damage signal detection unit 91 (Yes in step S11), the control device 9 switches the opening/closing valve 8 into an open state (step S12).

Some of the water intruding into the first watertight compartment 6A flows into the second watertight compartment 6B of the side shell 3B side through the connection pipe 7. Then, the hull 2 in which the outer surface of the side shell 3A is inclined downward returns to the normal position that was originally stabilized. Further, the water flowing into the second watertight compartment 6B collides with the side shell 3B and rebounds therefrom, and some of the water flows into the first watertight compartment 6A through the connection pipe 7. Then, the hull 2 heels toward the side shell 3A side again.

As shown in FIG. 5, the amplitude is gradually attenuated while the hull 2 repeatedly rolls due to the free water effect in which the water comes and goes between the first watertight compartment 6A and the second watertight compartment 6B through the connection pipe 7.

The elapsed time measurement unit 92 of the control device 9 starts measurement of the elapsed time after detection of the damage generation signal when the damage generation signal is detected by the damage signal detection unit 91 in step S11 (step S13). The elapsed time measurement unit 92 outputs a signal indicating the measured elapsed time.

The hull state detection unit 93 detects the heel angle of the hull 2, the roll amplitude of the hull 2, or the like, using the inclination sensor or the like every fixed small time period, and outputs the detected signal (step S14).

The determination unit 94 of the control device 9 monitors the signal indicating the elapsed time from the elapsed time measurement unit 92, and the signal indicating the heel angle or the like of the hull 2 output from the hull state detection unit 93 while the ship 1 repeatedly rolls as described above.

The determination unit 94 determines whether the elapsed time has reached the predetermined setting time value T every fixed time period (step S15). The control device 9 continues the process according to the determination result of the determination unit 94 when the elapsed time has not reached the setting time value T. The control device 9 outputs the signal of switching the opening/closing valve 8 into the closed state according to the determination result of the determination unit 94 when the elapsed time has reached the setting time value T (step S17).

The determination unit 94 determines whether the amplitude of the hull 2 has reached a predetermined state every fixed time period based on the signal indicating the heel angle or the like of the hull 2 output from the hull state detection unit 93 (step S16). When the roll amplitude of the hull 2 has not reached the predetermined amplitude according to the determination result of the determination unit 94, the process is continued (returns to step S14). The control device 9 outputs the signal of switching the opening/closing valve 8 into the closed state according to the determination result of the determination unit 94 when the amplitude of the hull 2 has reached the predetermined amplitude (step S17).

When the signal of switching the opening/closing valve 8 into the closed state is output from the control device 9 in step S17, the opening/closing valve 8 is switched into the closed state. When the opening/closing valve 8 is switched into the closed state, the water no longer oscillates between the first watertight compartment 6A and the second watertight compartment 6B through the connection pipe 7. Then, the water oscillates only separately in the first watertight compartment 6A or the second watertight compartment 6B, and the hull 2 does not easily roll.

According to the second embodiment, when the first watertight compartment 6A or the second watertight compartment 6B is a unit configured to accommodate liquid such as a ballast tank or the like, the opening/closing valve 8 is normally closed. In this case, for example, when damage to the side shell 3A occurs, the opening/closing valve 8 is first switched into the open state, the water or liquid in the first watertight compartment 6A is guided into the second watertight compartment 6B from the first watertight compartment 6A in which the side shell 3A is damaged through the connection pipe 7, like the first embodiment, and the inclination of the hull 2 can be attenuated.

After that, when the predetermined condition is satisfied, if the opening/closing valve 8 in the open state is switched into the closed state, the water or liquid no longer oscillate between the first watertight compartment 6A and the second watertight compartment 6B. Accordingly, the roll of the hull 2 can be suppressed and stable self-navigation becomes possible.

In this way, like the first embodiment, when the side shell 3A or 3B is damaged and the inside of the hull 2 is flooded, in a state in which the heel of the hull 2 is attenuated, the rolling of the hull 2 is suppressed. As a result, it is possible to provide the ship 1 capability of stable self-navigation even when the damage occurs.

Another Embodiment

The present invention is not limited to the above-mentioned embodiments but various modifications may be added to the above-mentioned embodiments without departing from the scope of the present invention. That is, specific shapes, configurations, or the like, described in the embodiments are examples, and appropriate modifications can be made.

For example, in the above-mentioned embodiments, the case in which the opening/closing valve 8 is switched into the closed state when either of the condition that the elapsed time from reception of the signal indicating damage has occurred in the side shell 3A or 3B has reached the predetermined setting time and the condition that the swing of the hull 2 has the predetermined amplitude whichever is early satisfied has been described. However, only one of the condition that either the elapsed time from reception of the signal indicating damage to the side shell 3A or 3B has occurred has reached the predetermined setting time or the condition that the swing of the hull 2 becomes the predetermined amplitude may be used as a predetermined condition.

Further, in the above-mentioned embodiments, the case in which the opening/closing control of the opening/closing valve 8 is performed based on the elapsed time and the amplitude has been described. However, for example, a condition of an absolute heel angle of the hull 2 may be added to the above-mentioned control. That is, on the premise that the heel angle of the hull 2 is the predetermined heel angle (as described above, 10°, 7°, 2°, or the like) or less, the opening/closing valve 8 may be switched into the closed state based on the above-mentioned elapsed time or amplitude.

Further, for example, the configuration of the first embodiment and the configuration of the second embodiment may be combined and used in one ship.

Further, the configuration of the ship 1 itself may assume any form.

INDUSTRIAL APPLICABILITY

The present invention may be applied to the ship. According to the present invention, when the damage to the side shell occurs and the water is guided from the first watertight compartment having the damaged side shell into the second watertight compartment through the connection section, if the predetermined condition is satisfied, as the opening/closing valve in the open state is switched into the closed state, a high stability can be obtained.

REFERENCE SIGNS LIST

1 Ship
2 Hull
3A, 3B Side shell
4 Ship's bottom
6, 6A First watertight compartment
6B Second watertight compartment
7 Connection pipe (connection section)
8 Opening/closing valve
9 Control device
10 Flooding detection sensor
91 Damage signal detection unit
92 Elapsed time measurement unit
93 Hull state detection unit
94 Determination unit
Si Internal space

The invention claimed is:

1. A ship comprising:

a hull having side shells formed at both sides in an athwart ship direction;

a first watertight compartment formed at one side in the athwart ship direction in the hull and a portion of which is divided and formed by the side shell of the one side;

a second watertight compartment formed at the other side in the athwart ship direction in the hull and a portion of which is divided and formed by the side shell of the other side;

a connection section configured to bring the first watertight compartment and the second watertight compartment in connection with each other;

an opening/closing valve configured to open and close the connection section; and a control device configured to control the opening and closing of the opening/closing valve, wherein the control device switches the opening/closing valve in an open state into a closed state when a predetermined condition is satisfied upon receiving a signal indicating an occurrence of damage to the side shell, and switches the opening/closing valve into the closed state when at least one of a condition that an elapsed time from reception of the signal indicating the occurrence of damage to the side shell reaches a predetermined setting time and a condition that the hull has a predetermined roll amplitude is satisfied as the predetermined condition.

2. A ship comprising:

a hull having side shells formed at both sides in an athwart ship direction;

a first watertight compartment formed at one side in the athwart ship direction in the hull and a portion of which is divided and formed by the side shell of the one side;

a second watertight compartment formed at the other side in the athwart ship direction in the hull and a portion of which is divided and formed by the side shell of the other side;

a connection section configured to bring the first watertight compartment and the second watertight compartment in connection with each other;

an opening/closing valve configured to open and close the connection section; and a control device configured to control the opening and closing of the opening/closing valve, wherein the control device switches the opening/closing valve in an open state into a closed state when a predetermined condition is satisfied upon receiving a signal indicating an occurrence of damage to the side shell, and the control device switches the opening/closing valve into the closed state when a condition that the hull has a predetermined amplitude is satisfied as the predetermined condition.

3. The ship according to claim 1, wherein the control device switches the opening/closing valve into the open state when the signal indicating the occurrence of damage to the side shell is received, and switches the opening/closing valve in the open state into the closed state when the predetermined condition is satisfied, where the opening/closing valve is normally in the closed state.

* * * * *